US009908678B2

(12) United States Patent
Hanson et al.

(10) Patent No.: US 9,908,678 B2
(45) Date of Patent: Mar. 6, 2018

(54) PROTECTIVE CONTAINER FOR A FLAT SCREEN MONITOR

(71) Applicant: BBY SOLUTIONS, INC., Richfield, MN (US)

(72) Inventors: James R. Hanson, Cottage Grove, MN (US); Kevin Florence, Golden Valley, MN (US); Nathan Omann, St. Louis Park, MN (US); Fredrick Larson, Cottage Grove, MN (US); Bryan Skaudis, Apple Valley, MN (US)

(73) Assignee: BBY SOLUTIONS, INC., Richfield, MN (US)

( * ) Notice: Subject to any disclaimer, the term of this patent is extended or adjusted under 35 U.S.C. 154(b) by 112 days.

(21) Appl. No.: 13/904,347

(22) Filed: May 29, 2013

(65) Prior Publication Data

US 2013/0277253 A1 Oct. 24, 2013

Related U.S. Application Data

(63) Continuation of application No. 11/717,870, filed on Mar. 14, 2007, now Pat. No. 8,474,614.

(51) Int. Cl.

| | |
|---|---|
| ***B65D 81/00*** | (2006.01) |
| ***B65D 81/02*** | (2006.01) |
| ***A47G 27/04*** | (2006.01) |
| ***B65D 85/30*** | (2006.01) |
| ***B65D 81/127*** | (2006.01) |

(52) U.S. Cl.

CPC ..... *B65D 81/02* (2013.01); *A47G 27/0406* (2013.01); *B65D 81/1275* (2013.01); *B65D 85/30* (2013.01); *B65D 2585/6837* (2013.01)

(58) Field of Classification Search

CPC ..... B65D 81/1275; B65D 2585/6837; B65D 85/30; G06F 1/1626; G06F 1/1628; A45C 2013/025; A45C 7/0086

USPC ..... 206/320, 449, 451, 453, 454, 455, 523, 206/583, 586, 591; 402/73–78; 294/149–152, 157, 158

See application file for complete search history.

(56) References Cited

U.S. PATENT DOCUMENTS 2,732,842 A 1/1956 Loudon
3,339,722 A 9/1967 Antwerpen
(Continued)

OTHER PUBLICATIONS

Sep. 28, 2009 Office Action dated (U.S. Appl. No. 11/717,870).
(Continued)

*Primary Examiner* — Ernesto Grano
(74) *Attorney, Agent, or Firm* — Tysver Beck Evans, PLLC

(57) ABSTRACT

The invention is a protective container for transporting an enclosed object such as a flat screen television or other flat screen monitor. The protective covering includes two flaps and a base having soft padding material on their inner surfaces. An open configuration is essentially flat, allowing a monitor to be easily positioned on the covering. The flaps fold up to transform the protective container into a closed configuration, with straps or other connectors holding the flaps in place. The protective container has various features making it convenient to move manually and to transport in a delivery truck. The protective container is more convenient to use than the prior art, and can be manufactured from relatively inexpensive materials.

28 Claims, 10 Drawing Sheets

(56) References Cited

U.S. PATENT DOCUMENTS

| | | | | |
|---|---|---|---|---|
| 3,438,488 | A * | 4/1969 | Rohde | B65D 85/48 206/454 |
| 3,769,741 | A | 11/1973 | Hessler et al. | |
| 5,031,733 | A | 7/1991 | Chang | |
| 5,161,762 | A | 11/1992 | Stewart et al. | |
| 5,251,945 | A | 10/1993 | Stoops | |
| 5,607,054 | A * | 3/1997 | Hollingsworth | G06F 1/1628 206/305 |
| 5,887,723 | A | 3/1999 | Myles et al. | |
| 5,934,473 | A | 8/1999 | Belshe | |
| 6,296,094 | B1 | 10/2001 | Knecht | |
| 6,301,826 | B1 | 10/2001 | Thorpe | |
| 6,604,618 | B1 * | 8/2003 | Godshaw | A45C 3/02 190/1 |
| 7,484,623 | B2 * | 2/2009 | Goodrich | B65D 19/20 206/600 |
| 7,588,148 | B2 | 9/2009 | Yang | |
| 2002/0166887 | A1 * | 11/2002 | Matsuoka | B65D 5/0227 229/117 |
| 2008/0131194 | A1 | 6/2008 | Williams | |
| 2012/0074823 | A1 * | 3/2012 | Bezich | B65D 43/22 312/240 |

OTHER PUBLICATIONS

Sep. 24, 2010 Office Action dated (U.S. Appl. No. 11/717,870).
Aug. 16, 2011 Office Action dated (U.S. Appl. No. 11/717,870).
Jun. 9, 2010 Office Action dated (U.S. Appl. No. 11/717,870).
Feb. 17, 2011 Office Action dated (U.S. Appl. No. 11/717,870).
Feb. 10, 2012 Office Action dated (U.S. Appl. No. 11/717,870).
Oct. 29, 2012 Office Action dated (U.S. Appl. No. 11/717,870).

* cited by examiner

PROTECTIVE CONTAINER FOR A FLAT SCREEN MONITOR

CROSS-REFERENCE TO RELATED APPLICATION

This application is a continuation of U.S. patent application Ser. No. 11/717,870, which is hereby incorporated by reference.

FIELD OF THE INVENTION

The present invention relates generally to a method and apparatus for protecting a flat screen television or other fragile object. More specifically it is directed to a protective container that folds around the object to enclose it on three sides.

BACKGROUND OF THE INVENTION

All their benefits notwithstanding, flat screen televisions are cumbersome, fragile, expensive objects. A television with a screen diagonal of 42 inches (107 cm) might have dimensions of 42×28×5 inches (width×height×depth), weigh 160 pounds (68 kg), and cost possibly exceeding a thousand dollars. Larger sets (e.g., with screen diagonals of 60 inches (152 cm) or more) are not uncommon. The television has a screen section containing a screen in a plastic case that encloses its electronics. Often, the screen section is mounted on a stand. The screen and the (usually plastic) stand are particularly fragile components.

Repair of an flat screen television or monitor often requires that it be taken from its place of installation (e.g., a family room in a home) to a remote service center in a delivery truck. Safe transport of the television to and from the service center can present a challenge to the one or two delivery persons that are sent to pick up the set. In the recent past, commercial delivery persons would often simply wrap the flat screen television in a blanket to carry it to the truck. Once in the truck, the television might be loose and in danger of being damaged, not attached to the inner walls of the truck. Needless to say, this approach might not inspire confidence in the observant customer/television owner. For the service center, the bulkiness, fragility, and expense combined to produce high risk of loss.

In the prior art, at the opposite extreme in terms of protectiveness are cases made of rigid plastic or metal, lined with foam material. These cases enclose the monitor on all sides. Because monitors come in a wide variety of shapes and sizes, a given rigid case fits only one or a very limited number of particular television models. The service center and delivery trucks would need an extensive suite of differently sized cases to accommodate the numerous possibilities. In addition to this inflexibility, these cases are very expensive to manufacture. Because of their great weight, which can approach 100 pounds (45 kg), these cases are usually equipped with casters to allow them to roll. On some surfaces the casters are helpful, but they mostly hinder rather than facilitate progress when negotiating stairways and the rough surfaces, gaps, dips and lips often encountered when such a large object is being loaded onto a truck.

SUMMARY OF THE INVENTION

The invention is an apparatus and method for protecting a fragile object that eliminates the principal disadvantages of the current technologies. It is easy to use, inexpensive, adaptable, and lightweight.

The protected object in the preferred embodiment is a flat screen television or computer monitor because the invention arose in the context of handling such devices, but the invention applies to protection of other types of objects as well. Henceforth, we will use the more generic term flat screen monitor, or simply monitor, to include flat screen televisions, and flat screen computer monitors, and other similar devices. While the remainder of the description of the invention will deal primarily with protecting a flat screen monitor, the reader should remember that is only an exemplary embodiment, and that protection of other objects is also contemplated by the invention.

The protective container includes a base and two flaps, which flank and are rotationally attached to the base, each along a respective fold axis. The base is generally rectangular in shape and generally two-dimensional (i.e., flat). The flaps are also generally two-dimensional; in some embodiments they are generally rectangular, but in others they could resemble a semi-circle or a semi-oval or other shape. The protective container has an inner surface and an outside surface; it also has an open configuration and a closed configuration. The monitor is usually placed onto the inner surface of the base when the protective container is in its open configuration and its outside surface lies flat in contact with the ground. The width, or longest dimension of the monitor, is oriented parallel to the fold axes. In some embodiments, the entire protective container in its open configuration is generally rectangular when viewed from above. In some embodiments, the flaps and base are fabricated from a single piece of material; in this case, the fold axis is along a bend in the material. In other embodiments, the flaps and base are separate, but are joined along the fold axis.

To change from the open configuration to the closed configuration, each flap is folded upward along its fold axis toward the opposite flap. The flaps are then attached to each other by one or more straps, cords, ropes, or other closure devices. Some or all of the inner surfaces of the base and flaps is covered with a cushioning material, such as a compressible foam, (for example, one fabricated from plastic polymer).

When a monitor is positioned as has been described on the base and the protective device is in the closed configuration, the bottom, front, and back sides of the monitor are enclosed by the protective container. The protective container is essentially open along the sides and top of the monitor, although one or more connectors may extend between the sides across those openings. In the closed configuration, some or all of the cushioning material included in the sides of the protective device will be in contact with the front and back of the monitor.

In some embodiments, the panels of the protective container (i.e., the base and flaps) are fabricated from polypropylene plastic. In the preferred embodiment, the polypropylene is 6 mm thick and contains flutes (thin hollow cavities) that are oriented perpendicular to the fold axes and, in each panel, are parallel to the plane of the panel. The flutes help to keep the protective device lightweight and reduce its cost. The orientation of the flutes stiffens the flaps in the upward direction when the protective container is in its open configuration. The material is not, however, entirely rigid in the upward direction; a certain amount of flexibility is useful in allowing the flap cushioning material to be adjusted with the connecting apparatuses (i.e., usually straps or belts) to be contoured into better contact with the monitor.

The base of the protective device may have integrated components to provide additional protection to the monitor.

In some embodiments, the base has two integrated support blocks that are separated from each other by a distance D. The screen of the monitor rests on the support blocks, which have a cushioned upper surface, while the stand is suspended between the support blocks. As mentioned previously, stands are a relatively fragile component of a flat-screen monitor. While such suspension is preferred to protect the stand, sometimes a technician will place a monitor having width less than D into the protective device. In this case, the weight of the monitor will rest directly on its stand between the two support blocks. To minimize the risk of breakage in this situation, the upper surface of the portion of the base between the two support blocks is also padded. Typically, the support blocks will extend across the base from one fold edge to the other. The support blocks prevent the monitor from slipping along the base in a direction parallel to the sides of the protective device.

In some embodiments, the support blocks will be hollow to help reduce the weight of the protective device. In some embodiments, the support blocks will be closed on all sides. In others, they will be open on two sides, such as the sides of the support blocks that face the flaps when the protective container is in the closed configuration.

Typically, there will be two top straps or belts across the top of the protective device to keep it in the closed configuration. Each of these belts will have a section attached to the opposite flaps of the protective container. The two sections join with a connector; typically one section ends in a female connector part and the other in a matching male connector part. The length of the strap can be adjusted to make the sides fit the monitor snugly.

Also typically, two sets of end straps configured similarly to the top straps extend from flap to flap across each open end of the protective container. On each end, these two sets of straps are essentially horizontal and parallel to each other when their two sections are connected and the strap is appropriately tightened. These straps can be adjusted to bring the flap padding close to the monitor, thereby taking advantage of the slight flexibility of the flaps. They also serve to keep the monitor between the ends of the flaps.

The protective container also has apparatuses (e.g., handles) at each end adapted to lifting and carrying it and the enclosed monitor. Preferably, the upper end strap can be used as the handle. If two people are available, one person can lift the device from each end by the respective handle.

Alternatively, one person can move the protective device and enclosed monitor using a two-wheeled hand truck. In some embodiments, a grip attached to one side near its top can be grasped by the hand-truck operator to hold the side of the protective device firmly as the hand truck is tilted around the axis of its wheels to lift and move the protective device and monitor. In some embodiments, the grip is a small strap loop.

If the protective device enclosing a monitor is being taken in a service vehicle to a repair facility, it should be secured to the side of the truck to keep it from being crushed by other contents or overturning. A clip attached to one flap of the protective device, typically by a strap or belt, is adapted to connecting to a bracket mounted to the inner wall of the vehicle.

DETAILED DESCRIPTION OF THE INVENTION

Figure 1:
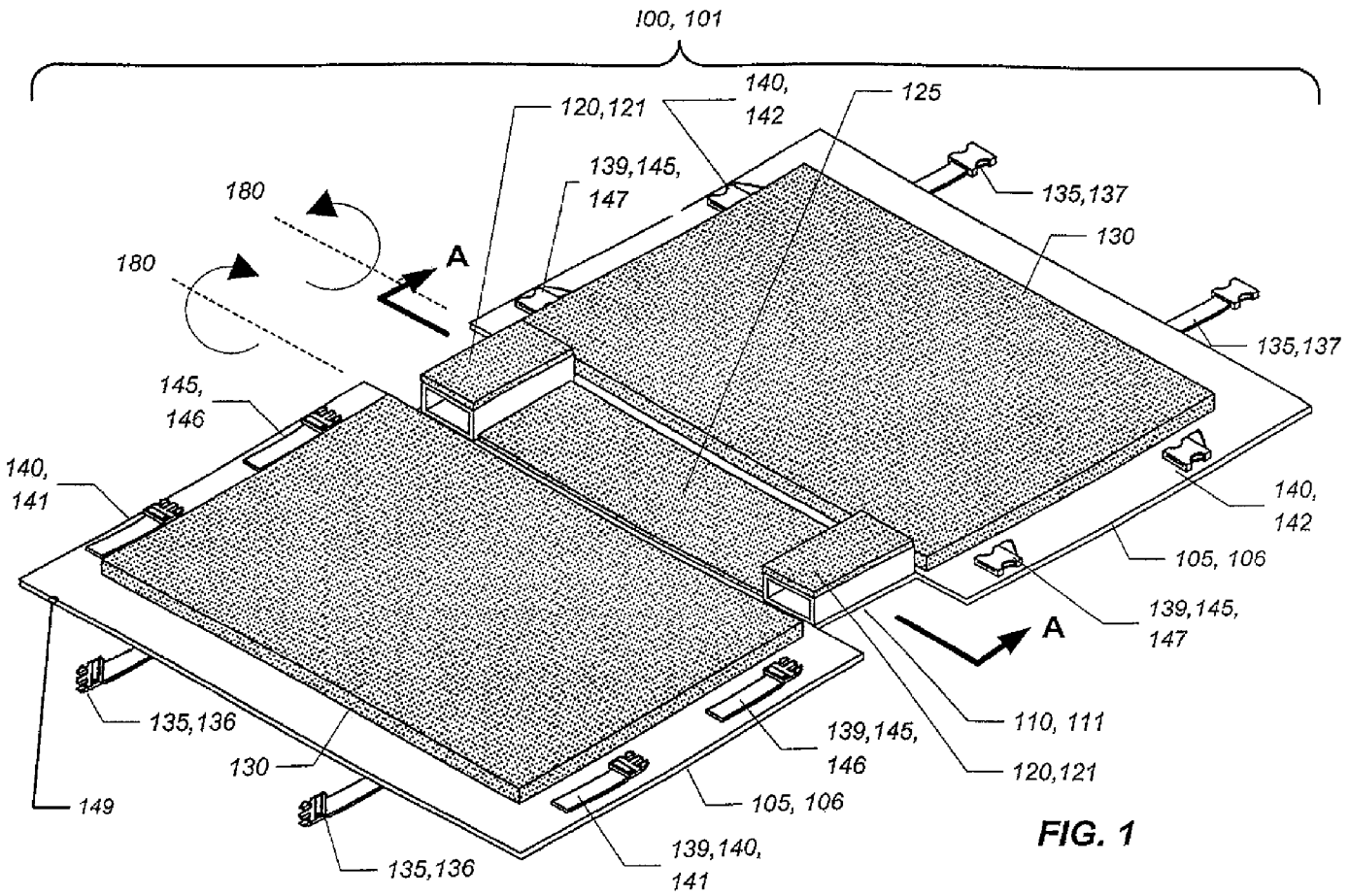
FIG. 1 is a perspective view of a protective container embodying the invention, in its open configuration.

FIG. 1 illustrates an embodiment of the invention, a protective container 100 for a flat screen monitor. The protective container 100 includes two flaps 105 and a base 110. The flaps 105 each contain a flap panel 106 and the base includes a base panel 110. The base panel 110 is essentially rectangular. The flaps 105 and base 110 are essentially flat, but in some embodiments of the invention are fabricated from a plastic material that makes them somewhat flexible. The two flap panels 106, which are also essentially rectangular, are attached to the base panel 110 along opposite edges of the base panel 110. In the open configuration 101 shown in FIG. 1, the three panels are essentially flat and coplanar, and each has a an upper surface and a lower surface. The lower surface rests on a rigid essentially horizontal surface (not shown) such as the floor of a building or truck, or the ground.

Figure 2:
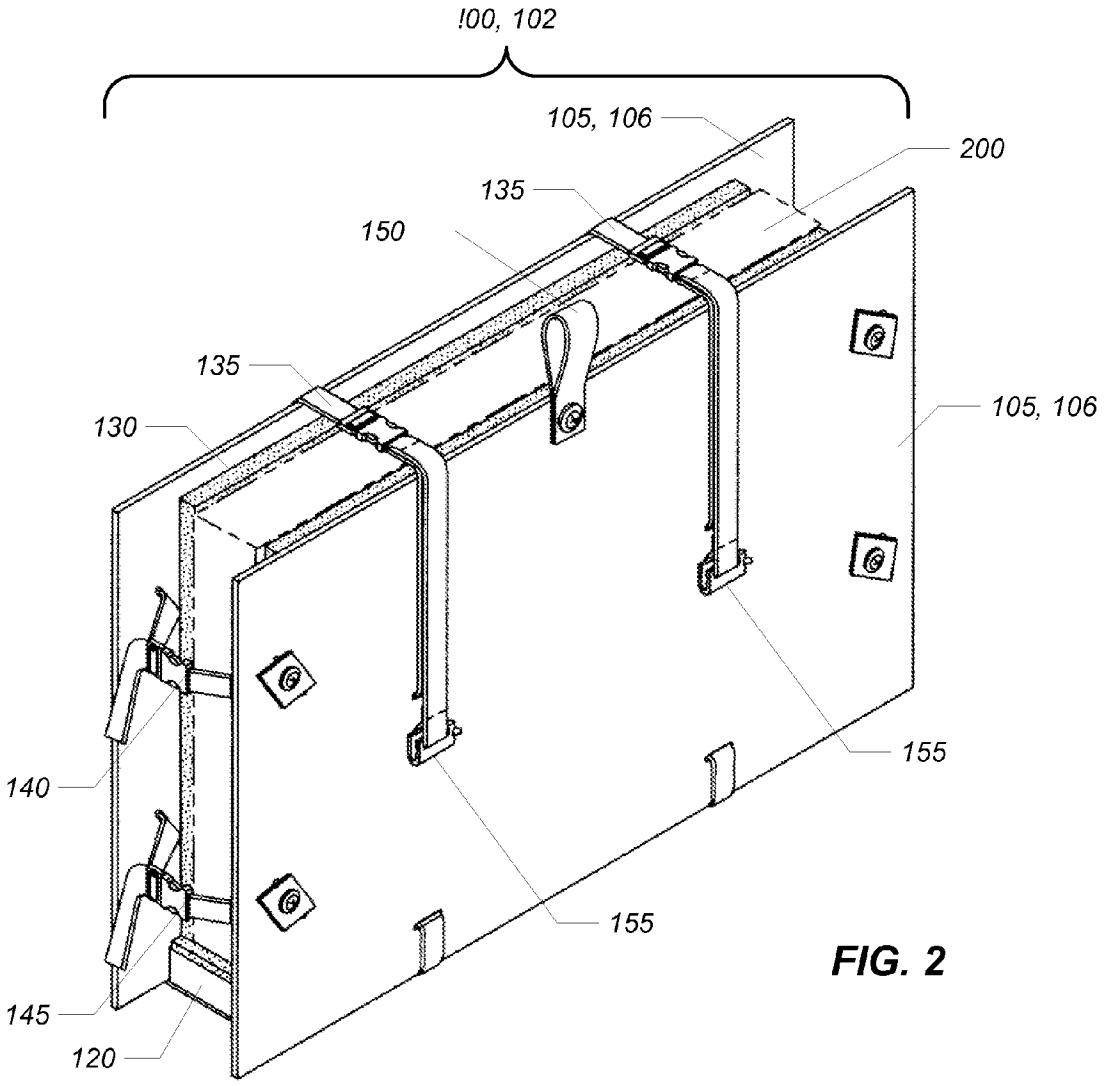
FIG. 2 is a perspective view of a protective container embodying the invention, in its closed configuration.

Each flap 105 can fold upward along a fold axis 180 that is coincident with the edge of the base 110 to which the flap is attached. Folding the two flaps 105 toward each other along respective fold axes 180, as indicated by arrows in FIG. 1, transforms the protective container 100 from the open configuration 101 shown in FIG. 1 to the closed configuration 102 illustrated by FIG. 2. In the embodiment shown, the flap panels 106 and base panel 110 form a unitary outer shell of the protective container 100, consisting of a single sheet of plastic bent along the fold axes 180. The upper surfaces of the flaps 105 and base 110 shown in FIG. 1 become inner surfaces of the protective container 100 when it is in the closed configuration 102. In FIG. 2, the viewer sees the entire outside surface of one flap 105.

Attached to and covering some portion of the inner surface of each flap 105 is cushioning material that is used to protect an enclosed object, such as a flat screen monitor. In the particular embodiment of FIG. 1, the cushioning material is provided by a rectangular piece of compressible foam flap panels 106, one flap panel 106 attached to and covering about 75% of each flap 105. In some embodiments, the compressible foam is of a type fabricated from plastic polymer In some embodiments, the panels of the protective container (i.e., the base panel and flap panels) are fabricated from polypropylene plastic. In the preferred embodiment, the polypropylene is standard commercial 6 mm thick corrugated polypropylene material, although a range of thicknesses from 4 to 8 mm will work reasonably well. In some embodiments, the material contains flutes 149 (tubes describing thin hollow cavities) that have axes oriented perpendicular to the fold axes and, in each panel, are parallel to the plane of the panel. The hollowness of the flutes 149 helps to keep the protective container 100 lightweight and to reduce its cost. The orientation of the flutes 149 stiffens the flaps 105 in the upward direction when the protective container is in its open configuration. In other words, the flaps 105 resist sharp bending along lines parallel to the fold axes 180. However, the material is still somewhat flexible, so that tightening straps or belts that connect the flaps 105 can result in gentle contours that bring the flap cushioning material into good contact with the monitor. Thus, while the embodiments shown in the figures (e.g., FIG. 2) illustrate flap panels 106 that are exactly flat in the closed configuration 102, it should be noted that in other embodiments they will be somewhat curved. Also, in some embodiments, the angle between each flap panel 106 and the base panel 110 may be less than the 90 degree angle shown in the figures displaying the closed configuration 102.

In the embodiment shown in FIG. 1, two support blocks 120 are incorporated into the base 110 of the protective container 100. The purpose of the support blocks 120 is discussed below in connection with FIG. 3 and FIG. 4, which present cross-sections through the base 110 and support blocks 120 in the direction indicated by the section symbols designated 'A'. Between the support blocks 120, the base 110 is covered with a cushioning material 125 on its inner surface. The support blocks 120 themselves are also covered on top with cushioning material.

In the closed configuration 102, the flaps 105 are held together by straps. Within the scope of the invention, the number of straps and their positions are variable. In the particular embodiment shown, there are two top straps 135 and two end straps 139. Each top strap 135 has a female portion 136 ending in a female connector and a male portion 137 ending in a male connector. There are two end straps 139 on each end of the protective container 100, an upper end strap 140 and a lower end strap 145. Each upper end strap 140 has a female portion 141 and a male portion 142. Similarly, each lower end strap 145 has a female portion 146 and a male portion 147. When the protective container 100 is in its open configuration 101, the pairs of male and female connectors are disconnected.

In the closed configuration 102, the protective container 100 describes two essentially open end spaces that are essentially perpendicular to the flap panels 106 and the base panel 110, and an essentially open top space that is essentially parallel to the base panel 110.

Figure 3:
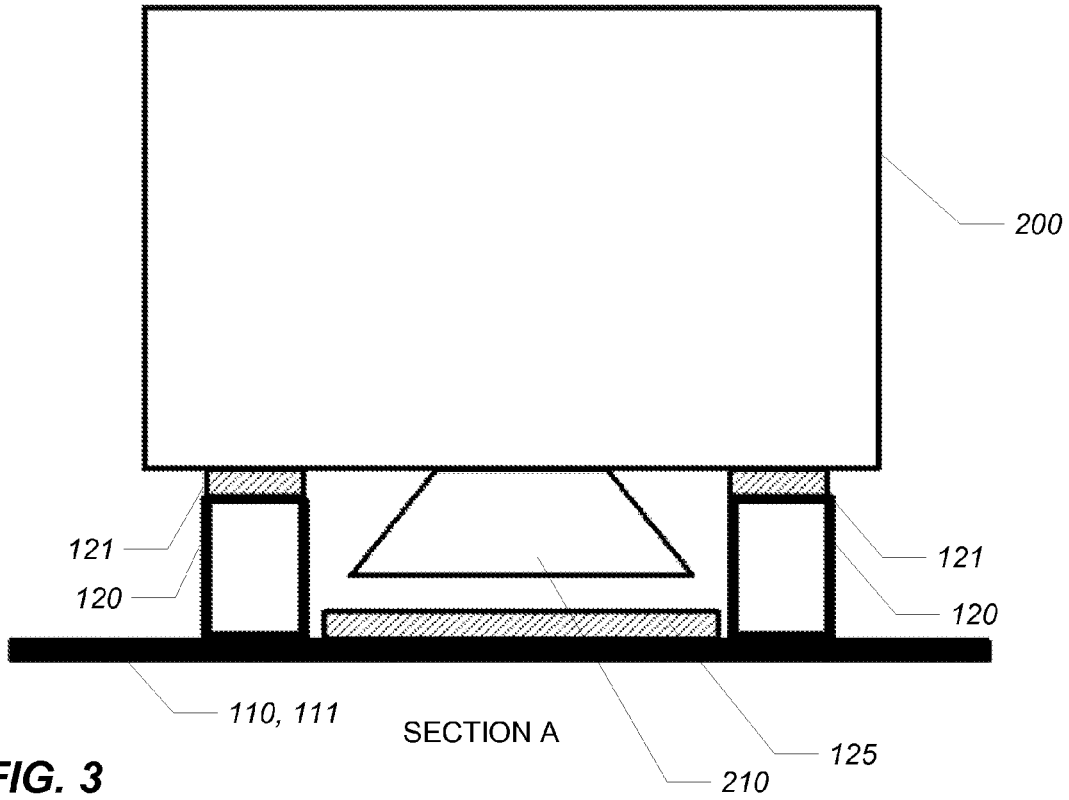
FIG. 3 is a cross-sectional view through the base of a protective container embodying the invention, the view illustrating how the support blocks eliminate stress on the stand of a large monitor set.
Figure 4:
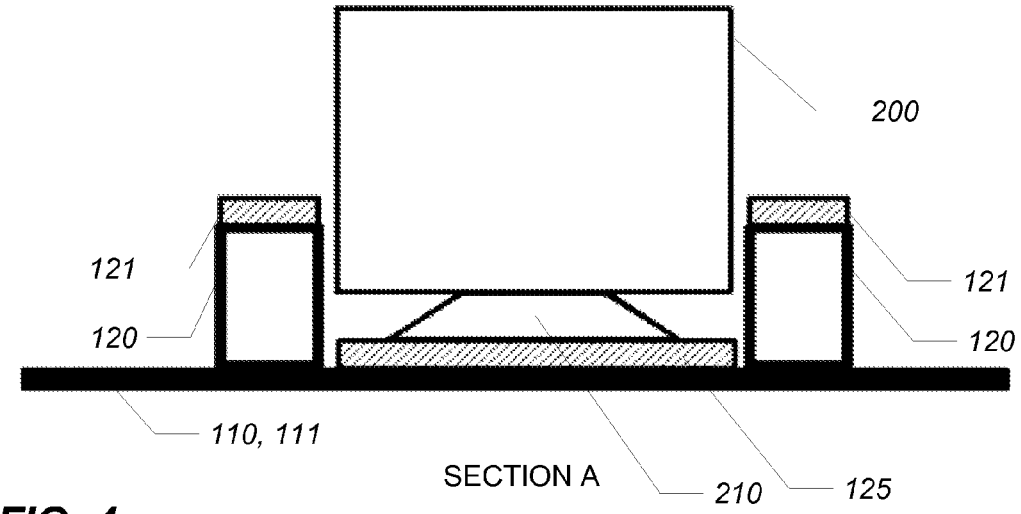
FIG. 4 is a cross-sectional view through the bottom of a protective container embodying the invention, the view illustrating how a small monitor set fits between the support blocks, resting on foam padding.

As discussed previously, flat screen monitors are large, heavy, cumbersome delicate, and expensive. Consequently, they are difficult to move and to position. When the protective container 100 of the invention is its open position, it lies flat on the ground or floor. Two people carrying a flat screen monitor, one from each end, can easily position the monitor onto the bottom section of the protective container 100, either suspended from the support blocks 120 as illustrated by FIG. 3, or between the support blocks 120 as illustrated by FIG. 4. Preferably, the support blocks 120 are hollow to act to some extent as shock absorbers to protect the monitor from vertical jostling. The materials and construction of the protective container 100 are sufficiently rugged that those people can even walk on the sides if necessary to more easily place the monitor onto the protective container 100.

FIG. 2 is a perspective view of an embodiment of the invention protective container 100 in its closed configuration 102. Outlined with dashed lines is a flat screen monitor 200, neatly sandwiched between the flaps 105 and cushioned by the flap panels 106 and the support block pads 121. As will be discussed below, for smaller monitors, the base panel 110 also plays a cushioning role. All female connectors are coupled to their male counterparts, holding the sides upright and in place. This FIG. 2 shows a feature that was not present in the embodiment illustrated by FIG. 1, namely, a hand truck grip 150, which in the illustrated embodiment is a hand truck strap 150. The hand truck strap 150 is adapted to loading the assembly, including the protective container 100 and the flat screen monitor 200 onto a hand truck, and will be described in connection with FIG. 8 and FIG. 9. Also shown in FIG. 2 are a pair of retainers 155, which are adapted to attaching the assembly to the inner side wall of vehicle. The retainers 155 are discussed in more detail in connection with FIGS. 10 through 12. In some embodiments, the hand truck strap 150 and the retainers 155 will be on the same flap 105 of the protective container 100 as shown in FIG. 2, while in other embodiments, they are on opposite flaps 105.

FIG. 3 is a cross-section through a protective container 100 in the direction indicated by the arrows labeled 'A' in FIG. 1. It shows a flat screen monitor 200 suspended from the support blocks 120, cushioned by the support block pads 121. The monitor 200 includes a stand 210, upon which it can rest when installed in a home or business. These stands 210 can be rather fragile. It is the purpose of the support blocks 120 to keep the weight of the screen portion of the monitor 200 off from its stand while it is being transported inside the protective container 100. To emphasize this point, the stand 210 of the monitor 200 in the figure is depicted as not touching the base panel 110. Because of compressibility of the base panel 110, however, in some cases the stand 210 can be in contact with the base panel 110 while still bearing little of the weight of the screen. The height of the support blocks 120 and the distance between them are chosen to accommodate a range of the most commercially popular models of monitors 200. This adaptability is a significant advantage over the rigid suitcase-like containers of the prior art.

While the protective container 100 is intended primarily to handle monitors 200 in the suspended position illustrated by FIG. 3, retail and delivery and servicing staff can be expected to misuse the protective container 100 by using it to transport a monitor 200 that, because of its small width, cannot be suspended between the support blocks 120. This situation is shown in FIG. 4. It is primarily to mitigate this common misuse that embodiments of the invention shown include a base panel 110.

Figure 5:
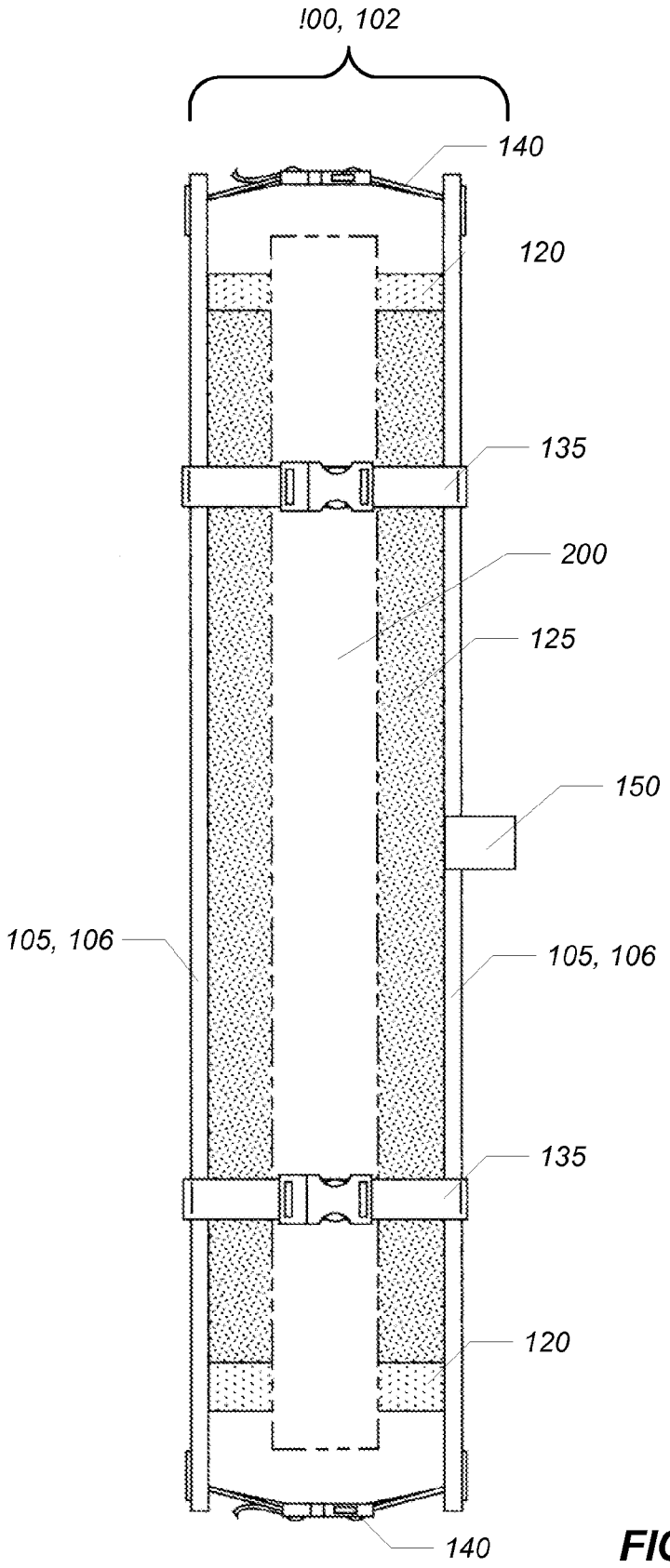
FIG. 5 is a top view of a protective container embodying the invention, in its closed configuration, with dashed lines indicating the position of a monitor.

FIG. 5 is a top view of an embodiment of a protective container 100 of the invention, showing a flat screen monitor 200 outlined with a dashed line. Like the one in FIG. 3, this monitor 200 is large enough to be properly suspended from the support blocks 120.

Figure 6:
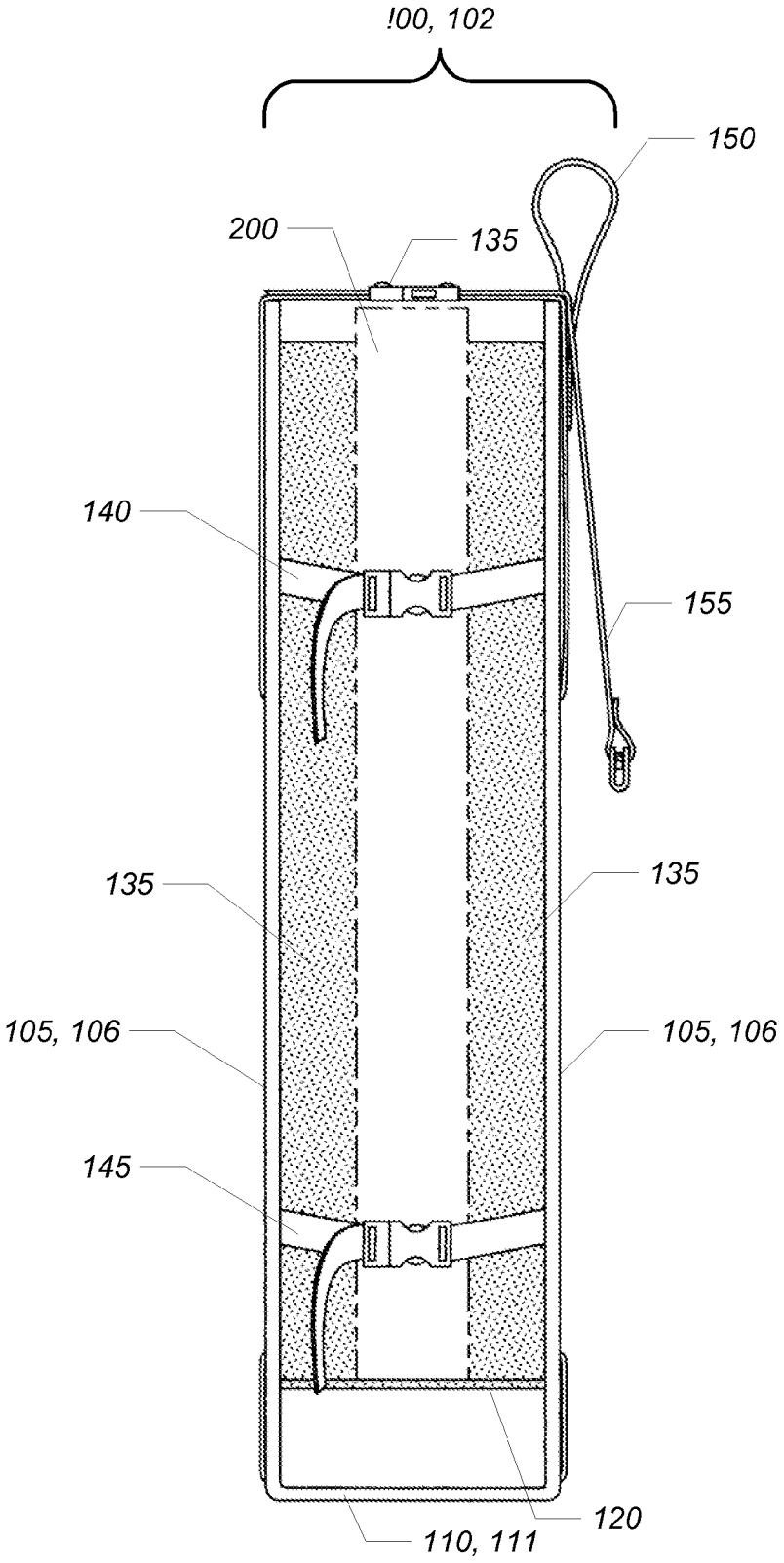
FIG. 6 is an end view of a protective container embodying the invention, in its closed configuration, with dashed lines indicating the position of a monitor.

FIG. 6 is an end view of a an embodiment of a protective container 100 of the invention. The features of this figure have already been discussed.

Figure 7:
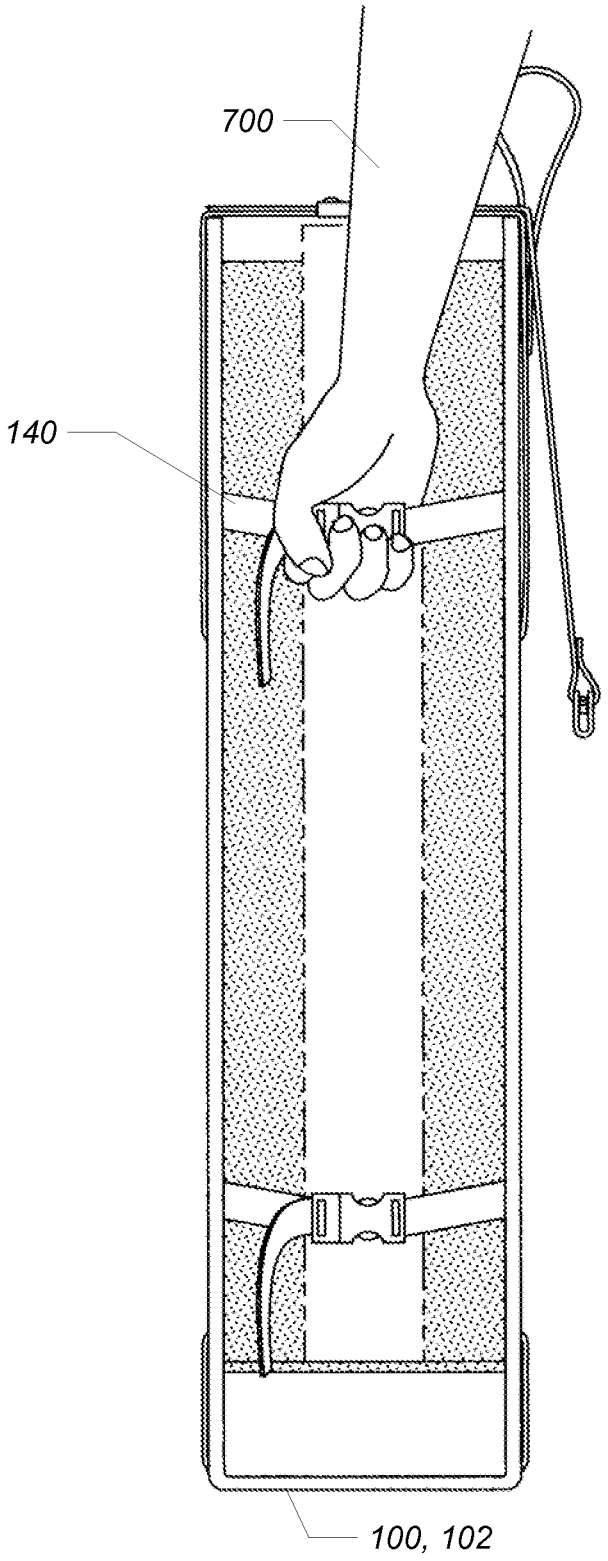
FIG. 7 is an end view of a protective container embodying the invention, in its closed configuration, with dashed lines indicating the position of a monitor, showing the assembly being lifted by an end strap.

FIG. 7 illustrates the usefulness of the upper end strap 140 as a grip for a human hand 710 to lift and carry the one end of the assembly. Because of the size and weight involved, two people are required to carry the assembly, one on each end. The upper end strap 140 can also be used for a single person to drag the assembly across a horizontal surface. Note that the end straps in the unit shown in the figure can alternatively be crisscrossed, which increases the sturdiness of the unit at some expense in portability. In this configuration, the male portion of the top strap would be connected to the female portion of the bottom one, and conversely.

Figure 9:
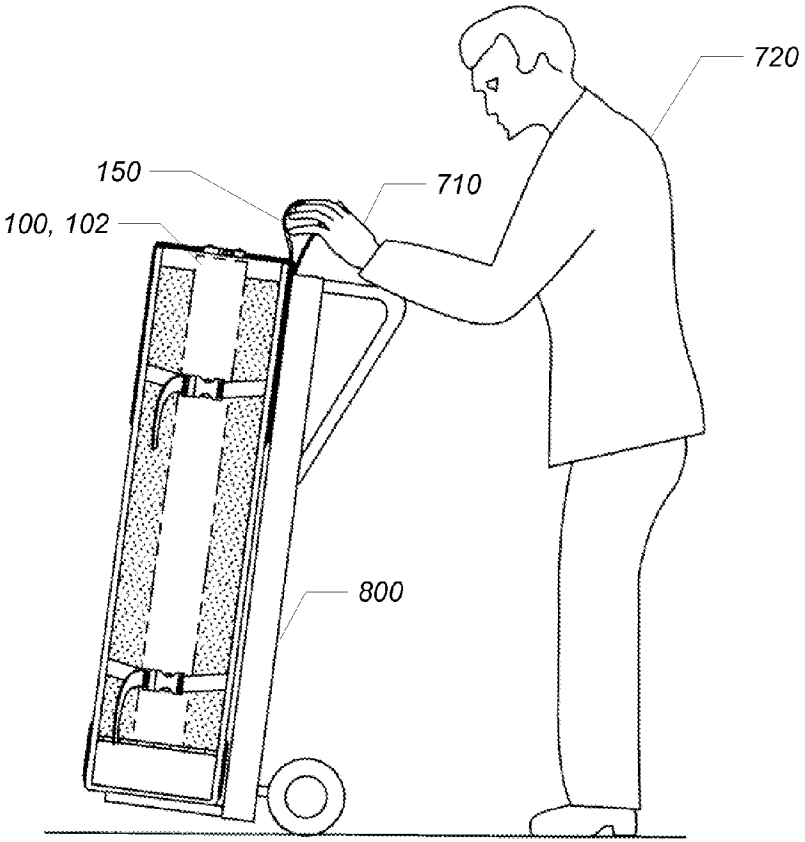
FIG. 9 is an end view of a protective container embodying the invention, in its closed configuration, with dashed lines indicating the position of a monitor, showing the hand truck grip securing the assembly as it is being moved on a hand truck.
Figure 8:
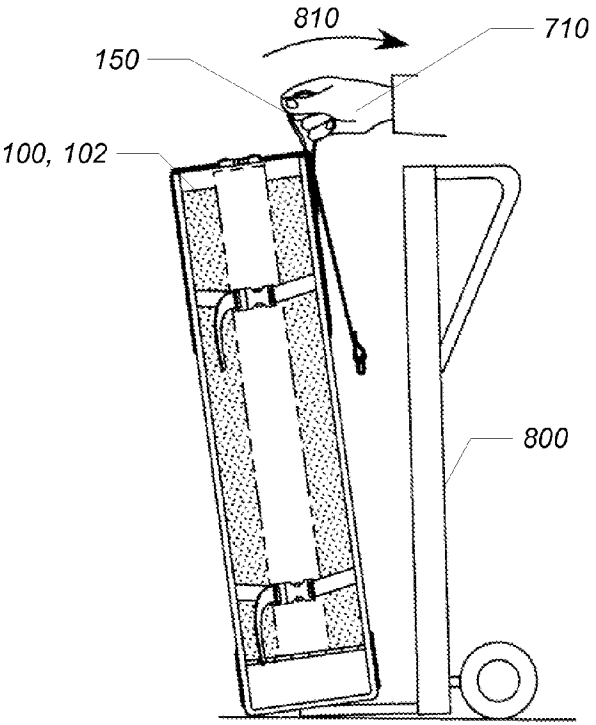
FIG. 8 is a end view of a protective container embodying the invention, in its closed configuration, with dashed lines indicating the position of a monitor, showing a hand truck grip being used to load the assembly onto a hand truck.

Sometimes only one person may be available to move the assembly of protective container 100 and monitor 200. As shown in FIG. 8, affixed proximate to the top of one flap 105 is a grip adapted to keeping the assembly from falling over as the flat bed of a hand truck 800 is slid underneath the assembly. A hand truck 800 is a two wheeled vehicle for manually moving large objects. In this particular embodiment, the grip is a hand truck strap 150. At indicated by the arrow 800, the hand truck strap 150 is adapted to being pulled by the hand 710 of a delivery person 720 to position it on the hand truck 800. At this point, as shown in FIG. 9, the assembly can be moved by a single delivery person 720. Over many surfaces where the casters of the prior art are impracticable, including many stairways and loading ramps, a hand truck 800 can move freely.

Figure 10:
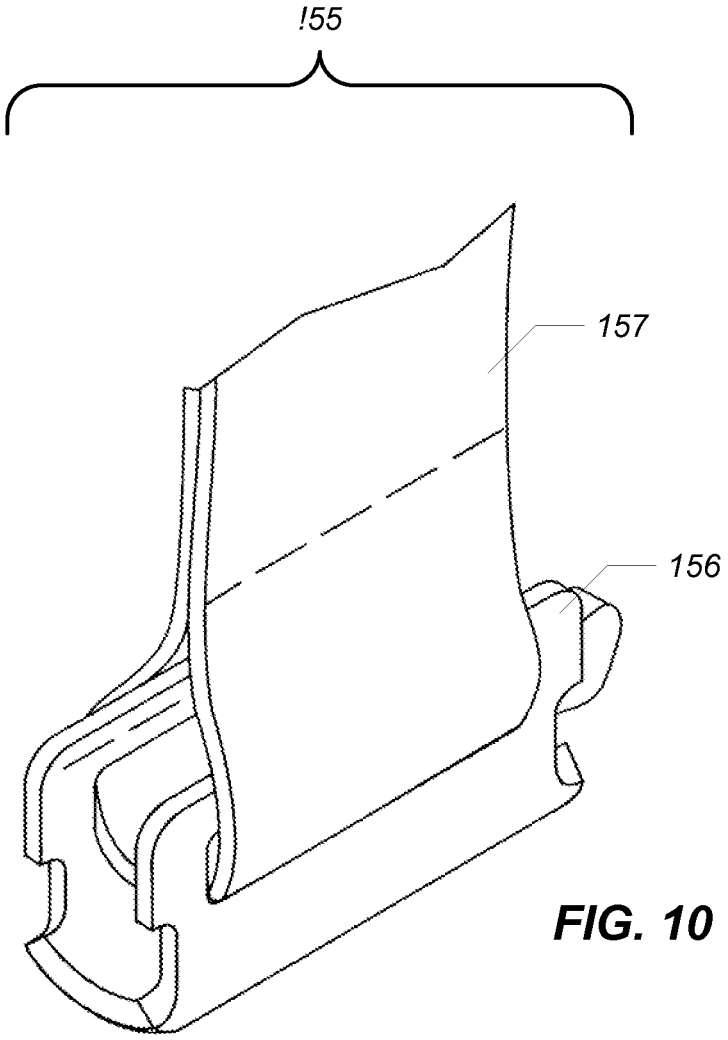
FIG. 10 is a perspective view of a retaining clip adapted to attaching the assembly to the inner side wall of a vehicle.
Figure 11:
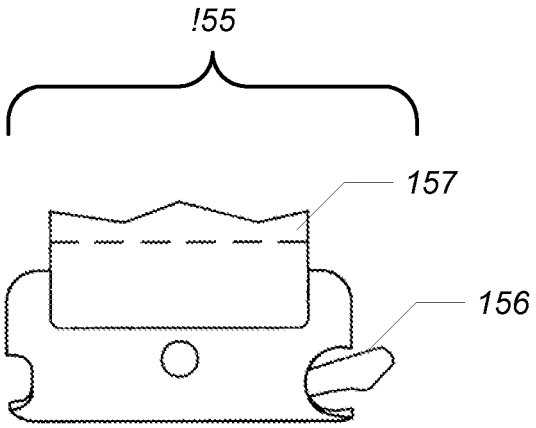
FIG. 11 is a front view of a retaining clip adapted to attaching the assembly to an inner wall of a delivery vehicle.

Some embodiments of the invention incorporate a retainer 155 strap or cord for securing the assembly to the inner side wall of a delivery vehicle, such as a truck, resting on the floor. One such embodiment is shown in FIG. 10, which has a retainer clip 156 attached to the end of a retainer strap 157. FIG. 11 is a front view that corresponds to the perspective view of FIG. 10.

Figure 12:
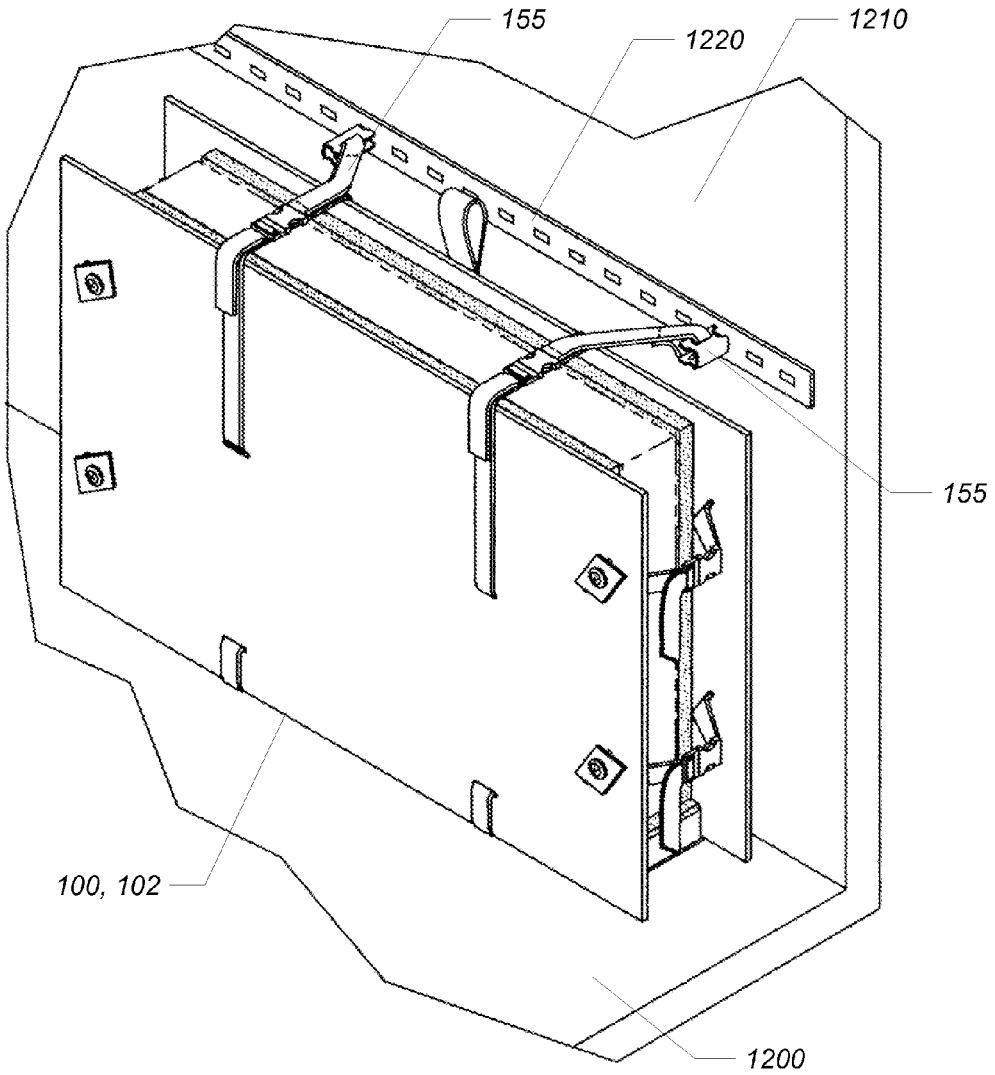
FIG. 12 is a perspective view of a protective container embodying the invention, in its closed configuration, with dashed lines indicating the position of a monitor, showing the retaining straps and retaining clips securing the assembly to an inner wall of a delivery vehicle.

FIG. 12 shows how the assembly might be attached to the inner side wall of a vehicle, such as a delivery truck. The base 110 of the protective container 100 rests on the floor 1200, with one flap 105 of the protective container 100 essentially flush against a side wall 1210 of the vehicle. The retainer clips 156 are clipped into a bracket 1220 that is mounted on the side wall 1210. The retainers 155 keep the protective container 100 and its contents from toppling over and from sliding around while the vehicle is in motion.

Figure 13:
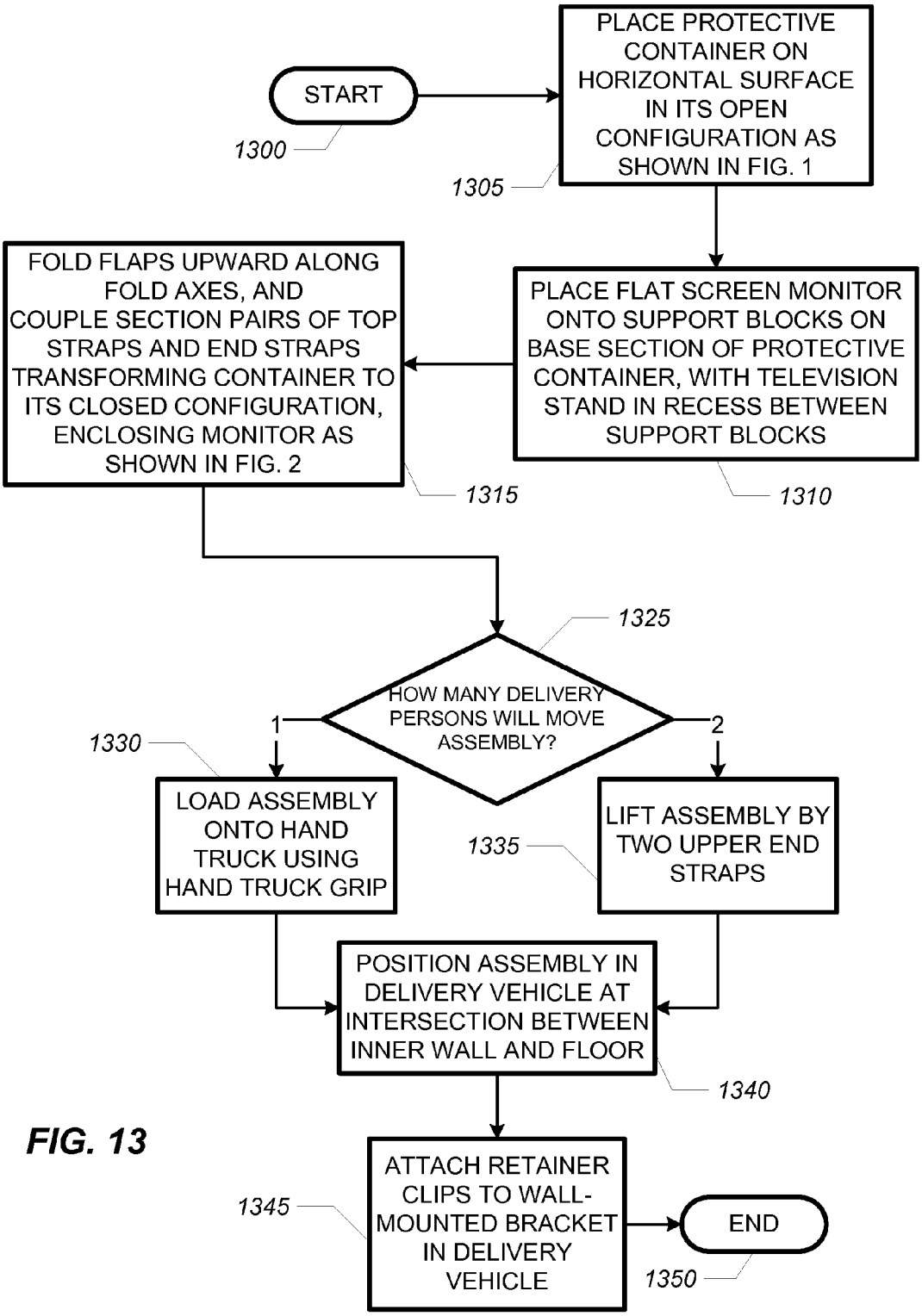
FIG. 13 is a flowchart depicting an embodiment of the method of the invention.

FIG. 13 is a flowchart showing a particular embodiment of the method of the invention. After the method starts 1300, the protective container 100 of the invention is placed 1305 on an essentially horizontal surface such as the ground or the floor of a building or a vehicle. The protective container 100 will be in its open configuration 101 as illustrated for one embodiment in FIG. 1. A flat screen monitor 200 is placed 1310 (usually carried) onto the protective container 100. Preferably, the size of the monitor 200 will be such that it can be suspended on the two support blocks 120 that are included in the base 110 of the protective container 100. If the monitor 200 has a stand 210, the stand 210 will be suspended between the support blocks 120. The protective container 100 is transformed 1315 into its closed configuration 102, illustrated for one embodiment in FIG. 2, by folding the flaps 105 upward along the two fold axes 180, and then connecting the flaps 105 using six straps, two across the top and two across each end of the protective container 100. Typically, each of these straps will have two portions, one ending in a female connector and the other ending in a matching male connector. If 1325 two delivery persons will move the assembly (i.e., the protective container 100 enclosing the flat screen monitor 200), then each of them lift 1335 the assembly from the upper end straps 140. Otherwise, the assembly will be loaded 1330 onto a hand truck 800 with the assistance of the hand truck grip 150. The hand truck grip 150 might also be used to keep the assembly from changing position as the hand truck 800 is rolled. One embodiment of a hand truck grip 150 is shown in FIG. 2, namely a loop of strapping material attached to a flap 105. The assembly is positioned 1340 on a delivery vehicle, resting on the floor 1200 against a side wall 1210. retainer clips 156 attached by straps to the protective container 100 are then engaged into a bracket 1220 mounted on the side wall 1210 of the delivery vehicle.

Of course, many variations of the above method are possible within the scope of the invention. Certain embodiments, for example, do not include some or all of steps 1325 through 1345. Also for example, the flaps 105 might be joined by a rope wrapped around the protective container 100 rather than by straps. If straps are used, their number and locations are variable. The protective container 100 might have more formal lifting handles proximate to each end rather than just providing the upper end straps 140 for lifting.

The present invention is not limited to all the above details, as modifications and variations may be made without departing from the intent or scope of the invention. Consequently, the invention should be limited only by the following claims and equivalent constructions.

What is claimed is:

1. An apparatus, comprising:

a) a base, including an essentially rectangular base panel, and two flaps, each flap including a flap panel, each flap panel attached to the base panel along a respective fold axis, the two fold axes coinciding with opposite edges of the base panel, each panel being nearly rigid;

b) a closed configuration, formed folding the flaps toward each other along the two fold axes;

c) cushioning material contained in or attached to the base; and d) two support blocks attached to an upper surface of the base panel, the support blocks separated in a direction parallel to the fold axes by a distance sufficient to suspend a screen portion of a flat screen monitor above the base panel when the base panel is horizontal, wherein each support block extends across the base panel from one fold axis to the other, wherein a hollow volume in each support block is accessible when the apparatus is in an open configuration; and e) a flat screen monitor, having the screen portion mounted on a stand, such that (i) when the apparatus is in the closed configuration, a screen display surface, in the screen portion, is approximately parallel to a flap, (ii) the stand rests on the cushioning material of the base, and (iii) the screen portion is supported by the stand.

2. The apparatus of claim 1, further comprising:

e) cushioning material contained in or attached to an upper surface of at least one of the support blocks.

3. The apparatus of claim 1, the distance being sufficient that a stand, to which the screen portion of the flat screen monitor is mounted, fits between the support blocks.

4. The apparatus of claim 3, further comprising:

f) the flat screen monitor, which, when the apparatus is in the closed configuration, is positioned between inner surfaces of the two flaps, and rests upon the cushioning material of at least one of the support blocks.

5. The apparatus of claim 3, the stand defining a stand bottom plane, the stand bottom plane being elevated by the support blocks by a nonzero distance above the base.

6. The apparatus of claim 1, further comprising:

f) a handle that, when the apparatus is in the closed configuration, extends between the two flaps across an end space defined by the base and the two flaps.

7. The apparatus of claim 6, wherein the handle contributes to maintaining the apparatus in the closed configuration.

8. The apparatus of claim 1, wherein the flap panels are essentially rectangular, each having a top edge essentially parallel to the base panel and two end edges each essentially perpendicular to the top edge, and wherein a securing connector extends either across a space between the respective top edges of the flap panels, or between respective end edges of the flap panels.

9. The apparatus of claim 1, further comprising:

f) a strap having two sections, one section attached to each flap, the two sections ending in mating couplers so that the two sections are detached when the apparatus is in an open configuration and coupled when the apparatus is in the closed configuration, and wherein the strap has an adjustable length.

10. The apparatus of claim 1, wherein the base panel and flap panels are formed by bending a single sheet of material along the fold axes.

11. The apparatus of claim 1, wherein the flap panels are fabricated from polypropylene.

12. The apparatus of claim 1, wherein at least one of the flap panels contains a plurality of essentially tubular flutes, the axis of a particular flute oriented perpendicular to the base panel and parallel to the outside surface of said flap panel when the apparatus is in an open configuration.

13. The apparatus of claim 12, wherein the flap panel containing the flutes is fabricated from polypropylene.

14. The apparatus of claim 1, wherein a hand truck grip of sufficient size to fit a human hand is attached to at least one of the flaps.

15. The apparatus of claim 1, wherein at least one of the hollow volumes is rectangular in combination with the base panel, each of the support blocks bounds four sides of a respective rectangular cavity.

16. The apparatus of claim 1, wherein the flat screen monitor includes an attached stand that is centered essentially midway along a bottom edge of a screen section of the monitor.

17. The apparatus of claim 16, the flaps having a length and a width larger than that of a monitor having a screen that has a diagonal of at least 107 cm.

18. The apparatus of claim 1, wherein the cushioning material covers essentially the entire horizontal area of the base.

19. The apparatus of claim 1, wherein the cushioning material further covers essentially an entire inner surface of one of the flaps.

20. The apparatus of claim 1, wherein the cushioning material is foam.

21. The apparatus of claim 1, further comprising:

f) the flat screen monitor, having a screen portion mounted on a stand, that, when the apparatus is in the closed configuration, is positioned between inner surfaces of the two flaps, and rests upon the support blocks, with the stand having no contact with the base panel.

22. The apparatus of claim 1, wherein one of the support blocks is proximate to an edge of the base that is perpendicular to a fold axis.

23. The apparatus of claim 1, wherein one of the support blocks is in contact with a flap when the apparatus is in the closed configuration.

24. An apparatus, comprising:

a) a base, including an essentially rectangular base panel, and two flaps, each flap including a flap panel, each flap panel attached to the base panel along a respective fold axis, the two fold axes coinciding with opposite edges of the base panel, each panel being nearly rigid;

b) a closed configuration, formed by folding the flaps toward each other along the two fold axes; and c) two support blocks, within the base, attached to an upper surface of the base panel and each extending from one fold axis to the other across the base in a direction perpendicular to the flaps, wherein a hollow volume in each support block is accessible when the apparatus is in an open configuration; and d) a flat screen monitor, having the screen portion mounted on a stand, such that (i) when the apparatus is in the closed configuration, a screen display surface, in the screen portion, is approximately parallel to a flap, (ii) the stand rests on cushioning material of the base, and (iii) the screen portion is supported by the stand.

25. The apparatus of claim 24, wherein the support blocks include cushioning material.

26. The apparatus of claim 25, further comprising:

e) a contained object that, when the apparatus is in the closed configuration, is positioned between inner surfaces of the two flaps, rests upon the base, and has some contact with cushioning material of the support blocks.

27. An apparatus, comprising:

a) a base, including an essentially rectangular base panel, and two flaps, each flap including a flap panel, each flap panel attached to the base panel along a respective fold axis, the two fold axes coinciding with opposite edges of the base panel, each panel being nearly rigid;

b) a closed configuration, formed by folding the flaps toward each other along the two fold axes;

c) a plurality of connecting devices, extending between the flaps, that secure the device in the closed configuration; and d) two support blocks attached to an upper surface of the base panel, the support blocks separated in a direction parallel to the fold axes by a distance sufficient to suspend a screen portion of a flat screen monitor above the base panel when the base panel is horizontal, wherein a hollow volume in each support block is accessible when the apparatus is in an open configuration; and e) a flat screen monitor, having the screen portion mounted on a stand, such that (i) when the apparatus is in the closed configuration, a screen display surface, in the screen portion, is approximately parallel to a flap, (ii) the stand rests on cushioning material of the base, and (iii) the screen portion is supported by the stand.

28. The apparatus of claim 27, wherein each support block extends across the base from one fold axis to the other.

* * * * *